United States Patent [19]

Martin

[11] Patent Number: 4,465,910

[45] Date of Patent: Aug. 14, 1984

[54] SELF-GENERATING GAS FLOW INTERRUPTER

[75] Inventor: Donald R. Martin, Racine, Wis.

[73] Assignee: McGraw-Edison Company, Rolling Meadows, Ill.

[21] Appl. No.: 420,038

[22] Filed: Sep. 20, 1982

[51] Int. Cl.[3] ..... H01H 33/00

[52] U.S. Cl. ..... 200/148 R; 200/148 A; 200/150 G

[58] Field of Search ..... 200/148 R, 148 A, 148 B, 200/148 C, 148 D, 148 E, 148 F, 148 G, 148 H, 148 J, 148 BV, 150 G

[56] References Cited

U.S. PATENT DOCUMENTS 4,278,860 7/1981 Wu ..... 200/148 R

FOREIGN PATENT DOCUMENTS 41081 12/1981 European Pat. Off. ..... 200/148 A

*Primary Examiner*—E. A. Goldberg
*Assistant Examiner*—Morris Ginsburg
*Attorney, Agent, or Firm*—J. C. Gealow; James A. Gabala; Hugh Gilroy

[57] ABSTRACT

An electrical circuit interrupter is disclosed having the characteristic of a puffer interrupter and a self-extinguishing gas flow interrupter. The interrupter comprises a generally hollow movable cylinder which is adapted to be filled with an arc extinguishing fluid and which has an opening at one end. A piston is sealingly and coaxially disposed within the cylinder so as to be movable between a first and second position to change the internal volume of the cylinder in flow communication with its opening. A fixed guide is provided to direct the motion of the piston within the cylinder. A stop is carried by the guide to limit the relative motion between the piston and the cylinder. A spring biases the piston against the stop. Disposed at the open end of the cylinder is an arc site such that the pressure within the cylinder increases as the energy released from the arc increases. One of the two contacts across which the arc is formed is carried by the cylinder. Thus, under low or no arc conditions, the piston is held by the biasing means against the stop as the cylinder moves relative to it. This forces arc extinguishing fluid in the vicinity of the arc. Under high current carrying or fault conditions, the biasing means is overcome by the energy released from the arc to control the temperature and pressure rise adequately enough to extinguish the arc by the self extinguishing principle.

8 Claims, 3 Drawing Figures

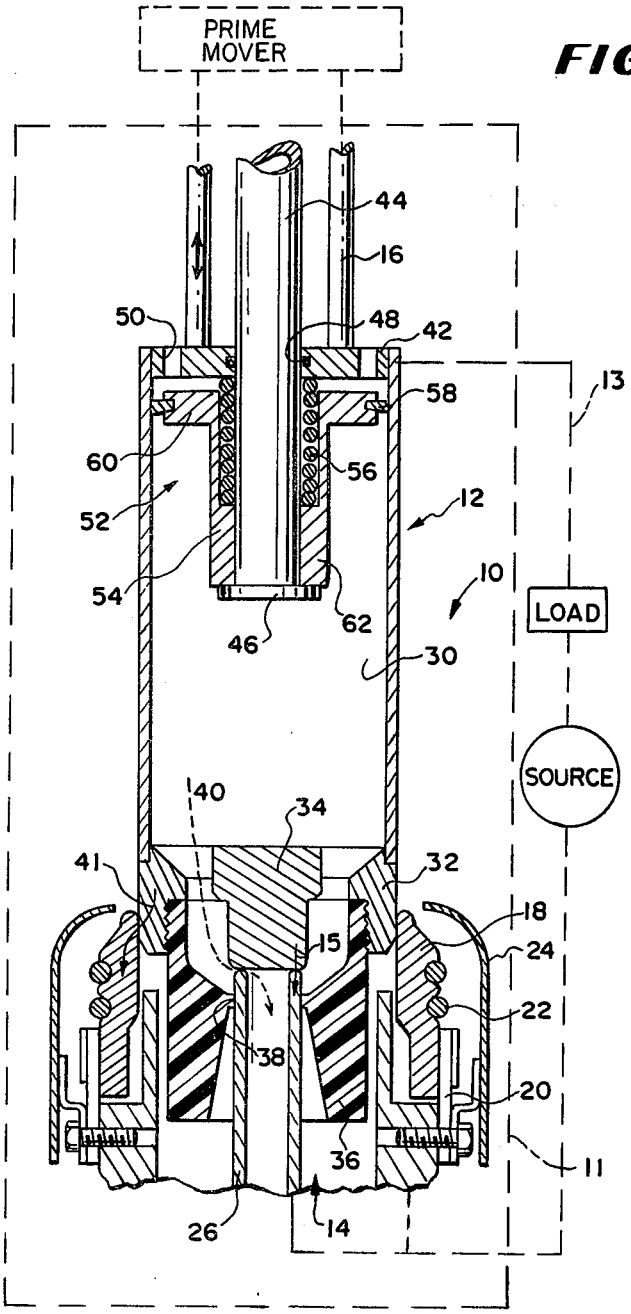
FIG. 1
FIG. 2
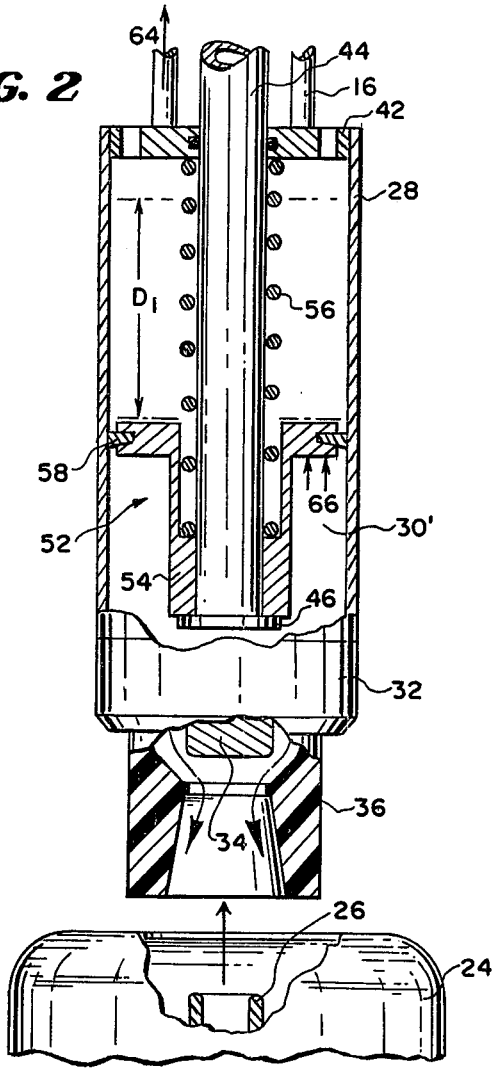
FIG. 3
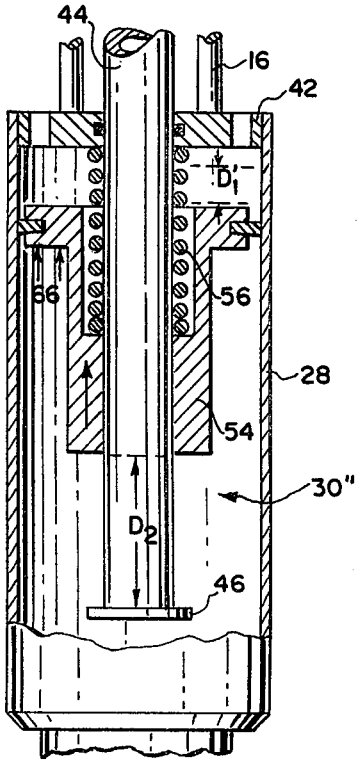

SELF-GENERATING GAS FLOW INTERRUPTER

TECHNICAL FIELD

This invention relates, in general, to circuit interrupters and, more particularly, to fluid-blast circuit interrupters of the puffer type.

BACKGROUND OF THE INVENTION

Puffer interrupters have enjoyed ever increasing commercial success. This is due in part to their simple construction and excellent service record. The increased use of puffer interrupters in power class circuit breakers has been at the expense of the more complex two-pressure interrupters. Unfortunately, as opposed to a two-pressure interrupter, a puffer interrupter requires a relatively large prime mover. In particular, the operating force required from the prime mover increases with the capacity of the interrupter. This is because, generally speaking, the interrupter increases in physical size as the choking arc current of the electrical arc increases. Accordingly, the prime mover must be more powerful.

The prime mover mechanism does not operate just during fault situations. In fact, during the life of an interrupter, a majority of time the puffer is opened with little or no load across it's contacts. Thus, for the most part, the prime mover or operating mechanism for a puffer interrupter is over-sized or is provided with excess capacity relative to what is needed to achieve interruption.

A relatively recent advance in design of circuit interrupters has been the so called "self-extinguishing" puffer interrupter. Here the pressure raising function of the electrical arc, due to the thermal energy released by the arc, is used to provide a source of high-pressure gas which is released through the arcing region to extinguish the arc. Those skilled in the art know that high-temperature arc extinguishing gas has a lower density which promotes ionization and has a relatively low insulating capability. In other words, higher temperature fluid has a higher conductivity and a lower capacity for extinguishing an arc. Thus, in a "self-extinguishing" puffer interrupter, large-capacity current interruption is difficult to obtain if the volume of fluid is kept constant. This limitation tends to off-set the benefits gained by being able to use a smaller prime mover. Several patents have been granted for inventions, the purpose of which is to improve the arc extinguishing capability during high current carrying conditions: U.S. Pat. Nos. 4,221,943; 4,225,762; 4,239,949; 4,242,550; 4,243,860; 4,253,002; and EPC No. 00 19 806.

From the foregoing it should be clear that high-pressure can be easily obtained when the arc current is large and that, as the arc current decreases, the pressure necessary to cause interruption becomes more difficult to achieve. This is because when the current is small, the pressure produced within the chamber surrounding the arc is generally insufficient to produce interruption (i.e., the volume is fixed and the thermal energy released is small). Several inventions have been patented whose purpose is to provide adequate arc extinguishing capability in the low current range: U.S. Pat. Nos. 4,259,555; 4,270,034; and 4,327,263. Examination of these patents and those previously cited will show that a satisfactory solution to the problem of providing a self-generating gas flow interrupter which performs satisfactory in both the high current and low current ranges has not yet been achieved. An inexpensive, relatively simple design for a self-generating gas puffer interrupter, which performs satisfactorily in both the high and the low current ranges, will be a welcome addition to the art.

SUMMARY OF THE INVENTION

In accordance with the present invention, an interrupter is disclosed which has a variable volume arc extinguishing chamber defined by a floating piston such that its volume is satisfactory for enabling the interrupter to function as a "self-extinguishing" puffer interrupter when a large current is interrupted and as a "puffer-interrupter" when small currents are interrupted. Specifically, in one embodiment an interrupter is provided that comprises: a fixed guide; a generally hollow movable cylinder which is coaxially disposed about the guide and open at one end; a piston which is coaxially disposed about the guide at the interior of the cylinder at the closed end of the cylinder; a spring or biasing means for biasing the piston between a stop element defined by the guide and the closed end of the cylinder; a means for producing an electrical arc at the open end of the cylinder in response to movement of the cylinder; and a prime mover for moving the cylinder towards and away from the arc site. The biasing means tends to maintain the piston against the stop when the cylinder is moved away from the arc site; therefore, in the absence of a high current carrying arc, the volume of the chamber defined by the piston and the open end of the cylinder varies directly in response to the stroke of prime mover. Effectively, the interrupter performs as a conventional "puffer interrupter". The biasing means is provided with a "spring constant" such that it is overcome by the energy released by the arc when a high current is interrupted. In this latter case, the volume of the arc extinguishing chamber varies in response to the stroke of the prime mover and the movement of the piston. Effectively the interrupter performs as a "self-extinguishing" puffer interrupter.

It will become readily apparent from the following detail description of the invention and the embodiments described therein that the motion of the piston is essentially independent of the motion of the two contacts generating the arc. Moreover, since the piston is free to move along with the cylinder (during high current interruption), the biasing means need only overcome the frictional forces between the piston and the cylinder walls; thus, the spring or biasing means does not impose a load against the prime mover when the interrupter is closed. Similarly, since the biasing means needs only to overcome frictional forces in order for the piston to remain fixed in position relative to the cylinder, the pressure of the arc extinguishing fluid will be maintained sufficiently high to interrupt the arc during low current flow conditions. Other advantages and features of the present invention will become apparent from the following description, from the claims and from the accompanying drawings.

BRIEF DESCRIPTION OF THE DRAWINGS

FIG. 1 is a cross-sectional elevational view of the interrupter that forms the subject of the invention with the interrupter in its closed position;

FIG. 2 is a partial, cross-sectional elevational view of the interrupter shown in FIG. 1 after the interrupter has been opened under a low or no electrical current flow condition; and FIG. 3 illustrates the operation of the apparatus shown in FIG. 1 after the interrupter has been opened during a high-current flow condition.

DETAIL DESCRIPTION OF THE PREFERRED EMBODIMENT

While this invention is susceptible of embodiment in many different forms, there is shown in the drawings and will herein be described in detail one specific embodiment with the understanding that the present disclosure is to be considered as an exemplification of the principles of the invention and not intended to limit the invention to the specific embodiment illustrated.

For ease of description, the interrupter that is the subject of this invention will be described in one particular orientation, specifically in the orientation illustrated in the drawings, and the terms "upper", "lower", etc., will be used with reference to this position. It will be understood however, that the apparatus of the invention may be manufactured, stored, transported, and sold in other orientation than that illustrated.

COMPONENTS

For the purpose of general orientation, the principal components of the invention will be identified with reference to FIG. 1. After all the major components have been described, the operation of the device will be explained with particular reference to FIGS. 2 and 3. As is the usual case, the circuit interrupter 10 is housed within a tank or enclosure 11 which is filled with an arc extinguishing gas such as sulfur-hexafloride ($SF_6$). The interrupter 10 is formed from two electrical current carrying members or assemblies 12 and 14 which are coaxially disposed relative to each other and which are interposed across an external electrical circuit 13 (schematically illustrated in phantom) by conventional current interchanges (not illustrated for purposes of simplicity). One current carrying member 14 (i.e., the lowermost of the two using the orientation of the drawings) is essentially fixed in position while the other current carrying member 12, the upper one, is mounted so as to be movable (i.e., raised and lowered) towards and away from the lower current carrying member 14.

The upper current carrying member 12 is moved by a prime mover of the type typically used for such applications and which are well known to those skilled in the art. One or more connecting rods 16 are used to join the upper current carrying member 12 to the prime mover. When the upper current carrying member 12 is fully lowered, the upper and lower current carrying members 12 and 14 come into contact with each other in an abutting relationship such that a good electrical current flow path (arrow 15) is formed and the interrupter 10 is said to be in its "closed or shut" position. When the two current carrying members 12 and 14 are fully separated (See FIGS. 2 and 3) interrupter 10 is said to be in its "open or tripped" position.

Turning first to the lower current carrying member 14, it comprises a plurality of radially disposed main contact fingers 18 and a fixed arcing probe 26. These fingers are held at one end by a set of leaf springs 20 and are inwardly compressed at the other end (i.e., their upper end) by a set of encircling garter springs 22. A shield 24 is disposed on the outside of the contact fingers 18. The fixed arcing probe 26 is disposed at the center of the contact fingers 18 and is generally tubular in form.

Turning now to the upper current carrying member 12, a hollow cylinder 28 is used to define an arc extinguishing chamber 30. The lower end of the cylinder 28 carries a spider assembly 32. The spider assembly 32 supports a coaxially disposed upper arcing probe 34. The spider assembly 32 also carries a nozzle element 36, formed from insulating material the throat of which 38 is disposed about the lower arcing probe 26 at a position intermediate the ends of the lower arcing probe so as to confine or channel the fluid flowing from the arc extinguishing chamber 30, through the spider assembly and towards the abutting ends of the two arcing probes 26 and 34 immediately following contact separation (See flow path defined by broken arrow 40). The abutting end of the lower arcing probe 26 is preferably shaped in the form of a Laval nozzle.

The contact fingers 18 are spaced relative to the spider assembly 32 such that the fingers engage the outer periphery of the spider assembly before the two arcing probes 26 and 34 come into contact. When the interrupter 10 is closed, most of the electrical current flowing across the two current carrying members 12 and 14 is by way of the spider assembly 32 and the encircling cluster of contact fingers 18 (See arrow 41). Although not illustrated, the lower arcing probe 26 can be "spring-loaded" with a lost motion assembly of the type generally illustrated in U.S. Pat. No. 4,112,276. When such a lost motion assembly is employed, the two arcing probes 26 and 34 separate from each other after the contact fingers 18 have cleared from the spider assembly 32. Thus, all of the electrical current flowing across the interrupter 10 is forced to pass between the two arcing probes 26 and 34 before they are separated. This ensures that a sharp clean arc is formed at the entrance of the nozzle 36.

Turning to the upper end of the cylinder 28, the upper end of the cylinder is joined to a cap 42. The cap, in turn, is joined to the connecting rods 16. The cap 42 is disposed about a fixed guide 44 (which may or may not be hollow or centrally disposed relative to the axis of the cylinder 28, depending upon the size and shape of the arc extinguishing chamber) which has one end disposed within the interior of the arc extinguishing chamber 30. In the embodiment shown in the drawings, this end of the guide is capped or plugged with a stop element 46 (the purpose of which will be explained in short order). The cylinder cap 42 carries a bearing 48 which engages the outer periphery of the guide 44. Finally, the cap 42 is provided with one or more flow channels or holes 50 so as to allow the upper end of the cylinder 28 to be vented to the enclosure or tank 11 which surrounds the interrupter 10 and which, of course, is filled with arc-extinguishing fluid.

Turning our attention now to the interior of the arc extinguishing chamber 30, a unique floating piston assembly 52 is provided to enable the interrupter 10 to perform satisfactorily when low, as well as high, electrical currents are interrupted. The floating piston assembly 52 consists of: a piston 54 disposed about the guide 44; a biasing means 56 disposed between the cylinder cap 42 and the piston 54; and a seal ring or sealing means 58 disposed between the interior of the cylinder 28 and the exterior of the piston 54. In the embodiment shown in the drawings, the piston 54 is in the shape of an inverted "top-hat". Specifically, the piston includes a brim portion 60 which is disposed at the upper end of the arc extinguishing chamber 30 and which carries the sealing means 58, and a barrel portion or section 62 which is disposed about the guide 44 and carries the biasing means 56. In the embodiment illustrated, the biasing means 56 is in the form of a coil compression spring disposed at the exterior of the guide 44 and at the interior of the barrel portion 62 of the piston 54. Since the piston 54 is disposed between the stop 46 and the cylinder cap 42, the biasing means 56 maintains the lower end of the piston against the stop when the interrupter 10 is closed (See FIG. 1). It should be clear that other spring-like devices and methods may be used to locate the floating piston assembly 52 relative the guide 44 and the surrounding cylinder 28.

Before proceeding to describe the operation of the interrupter 10, a few observations should be made. If the piston assembly 52 is held relatively fixed in position relative to the guide 44 when the cylinder 28 is raised (See arrow 64 in FIG. 2), then the change in volume of the arc extinguishing chamber 30 is essentially equal to the stroke or distance "D1" that the upper current carrying member 12 moves upwardly multiplied by the annular area bounded by the interior of the cylinder and the exterior of the guide (i.e., the area of the upper end of brim portion 60). However, if the floating piston assembly 52 moves upwardly along the guide 44 when the cylinder 28 is also moved upwardly (See FIG. 3), then the change in volume of the arc extinguishing chamber 30 is proportional to the area of the brim portion 60 of the piston 54 at the interior of the arc extinguishing member multiplied by the stroke "D2" of the piston relative to the fixed guide. It should also be noted that when an arc is formed across the two arcing probes 26 and 34 (i.e., the arc site), the pressure in the arc extinguishing chamber 30 increases, and a pressure force (See arrow 66 in FIG. 3) is applied upwardly against the floating piston assembly 52. The pressure force tending to move the floating piston assembly 52 upwardly is opposed by: (1) the pressure developed or built-up between the cylinder cap 42 and the brim portion 60 of the piston 54; (2) the biasing means 56; and (3) the frictional forces between the barrel section 62 and the guide 44, on one hand, and the sealing means 58 and the interior walls of the cylinder 28, on the other hand. Thus, by a judicial selection of: the size of the flow channels 50; the spring constant of the biasing means 56; the coefficient of friction between the piston 54 and the guide 44, on one hand, and the walls of the cylinder 28, on the other hand; and the size of the guide relative to the piston 54, the designer can control and regulate the pressure within the arc extinguishing chamber 30 and, most importantly, the flow of fluid available for arc extinction. This will become especially clear from the following explanation.

OPERATION

Now that the principle components of the interrupter 10 have been indentified and explained, the integrated operation of the interrupter will be described. To interrupt the current flowing across the interrupter (See arrow 41 in FIG. 1), the prime mover is operated to stroke or drive the upper current carrying member 12 away from the lower current carrying member 14 (See arrow 64 in FIG. 2). For purposes of generality let us first assume that little or no current is flowing through the interrupter. When the two arcing probes 34 and 26 are separated, an electrical arc is formed. The electrical arc heats and disassociates the arc extinguishing gas within the interior of the cylinder 28 so as to produce the source of high pressure gas. The flow of high pressure gas, when forced into the interior of the lower arcing probe 26 (See arrow 40), ultimately results in the extinguishing of the electrical arc. It should be clear that a biasing means 56 can be provided with a sufficiently high "spring constant" so as to maintain the floating piston assembly 52 essentially fixed in position and against the stop 46 throughout the arc extinguishing process. Effectively, the floating piston 52, is driven downwardly while the surrounding cylinder 28 is pulled upwardly by the prime mover. Thus, with little or no electrical current flowing, the interrupter 10 performs as an ordinary puffer interrupter.

Now turning our attention to FIG. 3, the operation of the interrupter 10 will be described when it operates under high current carrying or fault conditions. In this case, the energy released by the arc is substantially larger than that released when little or no current is flowing across the two arcing probes 34 and 26. Here sufficient pressure is generated within the arc extinguishing chamber 30″ so as to overcome the biasing means 56 and the frictional and mechanical forces associated with the floating piston assembly 52 so as to drive or move the piston 54 upwardly relative to its original position against the stop 46. Thus, relative to the situation described with respect to FIG. 2, adequate expansion space is provided for the gas in the arc extinguishing chamber 30 so as to provide for arc extinction without an excessive pressure and temperature build-up beyond which arc-extention could not be assured.

From the foregoing, it should be clear that the biasing means 56 should be sized such that downward movement of the floating piston assembly 52 (See FIG. 2) generates enough pressure in the arc-extinction chamber 30 so as to equal the minimum pressure rise necessary to interrupt those currents below which self-flow arc extinguishing action will be assured. This would also assure that the minimum force is needed (from the prime mover) to compress the spring 56 when the interrupter 10 is closed (See FIG. 1). Thus, the spring 56 needs only to be sized to overcome the friction forces associated with the floating piston assembly 52 in compressing the volume of gas within the arc extinguishing chamber 30′ (See FIG. 2). It should be apparent that the force will not be one which will significantly affect the force that needs to be provided by the prime mover in operating the interrupter 10.

From the foregoing, it should also be clear that numerous variations and modifications may be effected without departing from the spirit and scope of the novel concept of the invention. For example, although cylindrical geometry has been used in describing the operation of the invention, other shapes and orientations may be used. It is equally true the guide 44 need not be in the form of a centrally disposed rod or tube or that the piston 54 be in the shape of a "top-hat". Similarly, a plurality of guides may be provided to direct the motion of the floating piston assembly 52 within the cylinder 28. Thus, it should be understood that no limitation with respect to the specific apparatus illustrated herein is intended or should be inferred. It is, of course, intended to cover by the appended claims, all modifications which fall within the scope of the claims that follow.

What is claimed is as follows:

1. An interrupter, comprising:

a. a fixed guide defining an end element disposed generally at right angles to the longitudinal axis of the guide;

b. a generally hollow movable cylinder, which is coaxially disposed about said guide, having at one end a wall element sealingly disposed about said guide and having at the other end an opening, said cylinder being adapted to be connected to a prime mover so as to be movable along the axis of said guide between a raised and a lower position and being filled with an arc extinguishing fluid;

c. a piston, coaxially disposed about said guide and at the interior of said cylinder, which is axially and sealingly movable along said guide between a first position defined adjacent said opening by said end element and a second position defined by said wall element so as to define a variable volume chamber within said cylinder whose interior volume varies in response to the axial movement of said piston relative to said guide;

d. arc means for producing an electric arc at a site adjacent said cylinder opening, whereby the pressure of the fluid at the interior of said chamber increases when an arc is produced; and e. biasing means, disposed between said cylinder wall element and said piston, for biasing said piston against said end element, said biasing means being selected to apply a sufficiently high force against said piston to keep said piston against said end element when said cylinder is moved away from said arc site in the absence of an arc, whereby the interior volume of said chamber varies directly in response to the movement of said cylinder, said biasing means being selected to apply a sufficiently low force against said piston such that said biasing means is overcome by the energy released from said arc site when said energy is in excess of a predetermined amount, whereby the interior volume of said chamber varies in response to the movement of said cylinder and the movement of said piston relative to said fixed guide.

2. The interrupter set forth in claim 1, wherein said hollow cylinder defines an interior wall and, wherein said piston includes:

a. a disk portion the periphery of which is sealingly disposed within said interior wall of said cylinder; and b. stem means, complementary to said guide, for holding said disk portion at a spaced distance from said end element and for supporting said biasing means.

3. The interrupter set forth in claim 1, wherein said arc means is formed by two electrodes, one of which is fixed and the other of which is carried by said cylinder.

4. An interrupter, comprising:

a. a movable generally hollow elongated enclosure which is adapted to be filled with an arc extinguishing fluid and which has two ends with an opening at one of said two ends, said enclosure being axially movable between a closed and an open position, said enclosure being adapted to be connected to a prime mover and defining an interior volume;

b. piston means, sealingly and axially disposed relative to the interior of said enclosure and movable between a first position and a second position, for changing the interior volume of said enclosure adjacent said opening;

c. fixed guide means, sealingly disposed within the other end of said enclosure, for guiding the axial position of said piston means within said enclosure;

d. stop means, carried by one of said guide means and piston means and cooperating with the other of said guide means and piston means, for limiting the relative motion between said piston means and guide means within the interior of said enclosure;

e. biasing means, disposed between said guide means and said piston means, for biasing said piston means against said stop means, said piston means and enclosure defining a chamber which is in flow communication with said opening and whose volume varies in response to the axial position of said piston means and said hollow enclosure relative to said guide means; and f. arc means, operating in response to the axial position of said enclosure relative to said guide means, for producing an electric arc at a site adjacent to said enclosure opening and for increasing the pressure of the fluid within said chamber in response to said electric arc, said biasing means defining a first force to maintain said piston means against said stop means when said enclosure is moved from its closed position and away from said arc site in the absense of an arc, whereby the volume of said chamber varies in response to the movement of said enclosure, the release and production of energy by said arc having the effect of increasing the pressure of the fluid within the chamber so as to produce a pressure force against said piston means tending to overcome said biasing means, whereby in the event that said pressure force exceeds said first force the volume of said chamber varies in response to the movement of said piston means under the influence of arc energy and the movement of said enclosure.

5. The interrupter set forth in claim 4, wherein said arc means is formed by two electrodes, one of which is fixed and generally tubular in shape and the other of which is carried by said enclosure and generally solid in form.

6. The interrupter set forth in claim 4, wherein said guide means is a hollow shaft having a free end which is disposed within said chamber and which is plugged by said stop means.

7. The interrupter set forth in claim 4, wherein said enclosure includes a flow nozzle in its opening with said arc means disposed within said nozzle when said interrupter is in its closed position.

8. An interrupter, comprising:

a. an enclosure which is adapted to be filled with an arc-extinguishing fluid and which defines an opening therein, said enclosure being adapted to be connected to a prime mover so as to be movable between an opened and closed position;

b. piston means, sealingly disposed within the interior of said enclosure and movable between a first position and a second position relative to said enclosure, for changing the relative volume of said enclosure in flow communication with said opening;

c. stop means, fixed in position relative to said enclosure, for limiting the position of said piston means relative to said enclosure;

d. biasing means, carried by said piston means, for biasing said piston means against said stop means; and e. two-part arc means, adjacent to said enclosure opening, for producing an electrical arc and for applying a pressure force against said piston means in response to said arc, said arc means defining a tubular arc probe which is fixed in position relative to said enclosure, and a solid arc probe which moves along with said enclosure, said tubular and solid arc probes having ends which are in an abutting relationship relative to said enclosure opening when said enclosure is in its closed position such that pressurized fluid formed within said enclosure is discharged across the abutting ends of said two arc probes as said enclosure is moved to its opened position, whereby with little or no thermal energy released by said arc when said enclosure is moved to its opened position, said piston means remains generally fixed relative to said stop means and that end of said enclosure defining said opening moves towards said piston means, said arc being thereby extinguished for the most part by the mechanical compression of arc-extinguishing fluid within said enclosure, and in the event that a relatively large quantity of thermal energy is released by said arc when said enclosure is moved to its opened position, said piston means moves away from said stop means and in the direction of motion of said enclosure, said arc then being extinguished for the most part in a self-extinguishing manner.

* * * * *